US006164951A

United States Patent [19]

Rao

[11] Patent Number: 6,164,951

[45] Date of Patent: Dec. 26, 2000

[54] APPARATUS FOR SIMULTANEOUS PRODUCTION OF A PLURALITY OF CONSTRUCTION PANELS

[75] Inventor: Koppanati Bhaskara Rao, Hyderabad, India

[73] Assignee: Hyderabad Industries, Ltd., Hyderabad, India

[21] Appl. No.: 09/189,143

[22] Filed: Nov. 10, 1998

[51] Int. Cl.[7] ..... B28B 7/24; B28B 7/26

[52] U.S. Cl. ..... 425/449; 425/257; 425/338; 249/120

[58] Field of Search ..... 425/447, 449, 425/338, 62, 257; 249/119, 118, 120

[56] References Cited

U.S. PATENT DOCUMENTS 3,070,842 1/1963 Fuller ..... 227/139
3,691,608 9/1972 Lowrance ..... 29/211 D
4,102,367 7/1978 Shulman et al. ..... 141/231
4,135,695 1/1979 Capdevila et al. ..... 249/118
4,708,611 11/1987 Bouteiller ..... 425/62

*Primary Examiner*—Harold Pyon
*Assistant Examiner*—Emmanuel S. Luk
*Attorney, Agent, or Firm*—Venable; George H. Spencer; Ashley J. Wells

[57] ABSTRACT

Apparatus for producing construction panels includes a distribution tank for receiving a slurry for formation of the construction panels, the distribution tank having a plurality of separator plates disposed in a spaced apart relationship to each other so that a plurality of chambers are defined there between within the distribution tank and having an actuator device for raising and lowering respective ones of the plurality of separator plates; a plurality of discharge valves provided respectively for each of the plurality of chambers of the distribution tank; a plurality of flow discharge members disposed respectively below each of the plurality of discharge valves for receiving the slurry from the distribution tank; and a movable trolley having a plurality of chambers disposed respectively below each of the plurality of flow discharge members.

6 Claims, 3 Drawing Sheets

APPARATUS FOR SIMULTANEOUS PRODUCTION OF A PLURALITY OF CONSTRUCTION PANELS

BACKGROUND OF THE INVENTION

1. Field of the Invention

The present invention relates to an apparatus for simultaneous production of a plurality of construction panels. Though the invention describes an apparatus for manufacture of construction panels such as aerated panels, such an apparatus can be extended to other type of panels wherein the slurry is poured into multiple casting in pre-measured quantities.

2. Description of the Related Art

In the conventional method of manufacture of panels, facing sheets are located as side supports and a chamber is formed. A measured quantity of slurry is separately poured into the formed chamber to produce the panels.

It is also known to prepare the slurry in a mixing tank and in substantial larger quantities and transfer the slurry to pre-measuring tanks and feed to the panel chamber. In such a system, and when large quantities of panels are to be manufactured, the process is time consuming as the pre-measuring tank is to be fed each time, signal to be taken for the level attained and emptying. Such a cycle is to be repeated.

In the known process for manufacture of aerated panels, slurry is to be discharged into a panel chamber before aeration starts. A disadvantage of such a known process is that only small quantities of slurry can be prepared resulting in a lower production rate. Further, in the conventional process, each panel chamber is to be brought nearer to the pre-measuring tank and then moved, which consumes more time and hampers mass production of panels.

An object of this invention is to propose an apparatus for producing panels, which has a higher rate of production.

Yet another object of this invention is to propose an apparatus for producing panels which is automatic and hence the production of panels is cost effective.

Still another object of this invention is to propose an apparatus for producing panels which provides a consistency in the quality of the panels.

SUMMARY OF THE INVENTION

According to this invention there is provided an apparatus of the production of constructional panels comprising:

a) a distribution tank having a plurality of chambers, each of said chambers adapted to receive a slurry for formation of the panels;

b) a discharge valve with each of said chambers;

c) a flow discharge member disposed below of said discharge valves for receiving the slurry from the distribution tank;

d) a movable trolley assembly adapted to be disposed below the said flow discharge member, said movable trolley assembly also having a plurality of chambers for receiving the slurry from said flow discharge member.

In accordance with this invention, a prepared slurry is first fed into a distribution tank. The distribution tank has a plurality of separator plates disposed in a spaced relationship to each other and such as to define a plurality of chambers, a chamber being provided for storage of slurry required for each panel. The separator plates are connected to any actuating means for raising or lowering of said plates. In a initial operation, the separator plates are in a raised position and a prepared slurry is filled into said distribution tank. Once the filling operation is completed, the separator plates are lowered into the tank so as to define a plurality of chambers, a chamber being provided for storage of slurry required for manufacture of each panel.

The distribution tank has a discharge valve disposed at the bottom of each of said chambers. When the valves are actuated into an open status, the slurry from the chambers of the distribution tank flows into a slurry discharge member. The slurry discharge system comprises a flexible pipe connected to each of the discharge valves of the distribution tank at the upper end. The lower end of said pipes is connected to its respective slurry discharge nozzle. The slurry discharge nozzles are connected to any known means for causing a raising and lowering of said nozzles.

The trolley assembly is disposed below the slurry discharge nozzles and slurry discharge nozzles are made to move down into the chambers of the panels mounted on trolley assembly which ensures that slurry is discharged into the chamber without any spillage.

Once the slurry is discharged into the chamber mounted on the trolley, the discharge nozzles are retrieved back, the top extrusions inserted on each of the chamber and trolley assembly moved to the next station. Meanwhile, the next trolley assembly is disposed below the slurry discharge nozzles and the process repeats.

After a preset period, top extrusion and side frames are removed, and the panel separated. The extrusions and supports are cleaned and made ready for next trolley assembly and the process repeats.

DESCRIPTION OF INVENTION WITH REFERENCE TO DRAWINGS

Further objects and advantages of this invention will be more apparent from the ensuing description when read in conjunction with the accompanying drawings and wherein.

Figure 1:
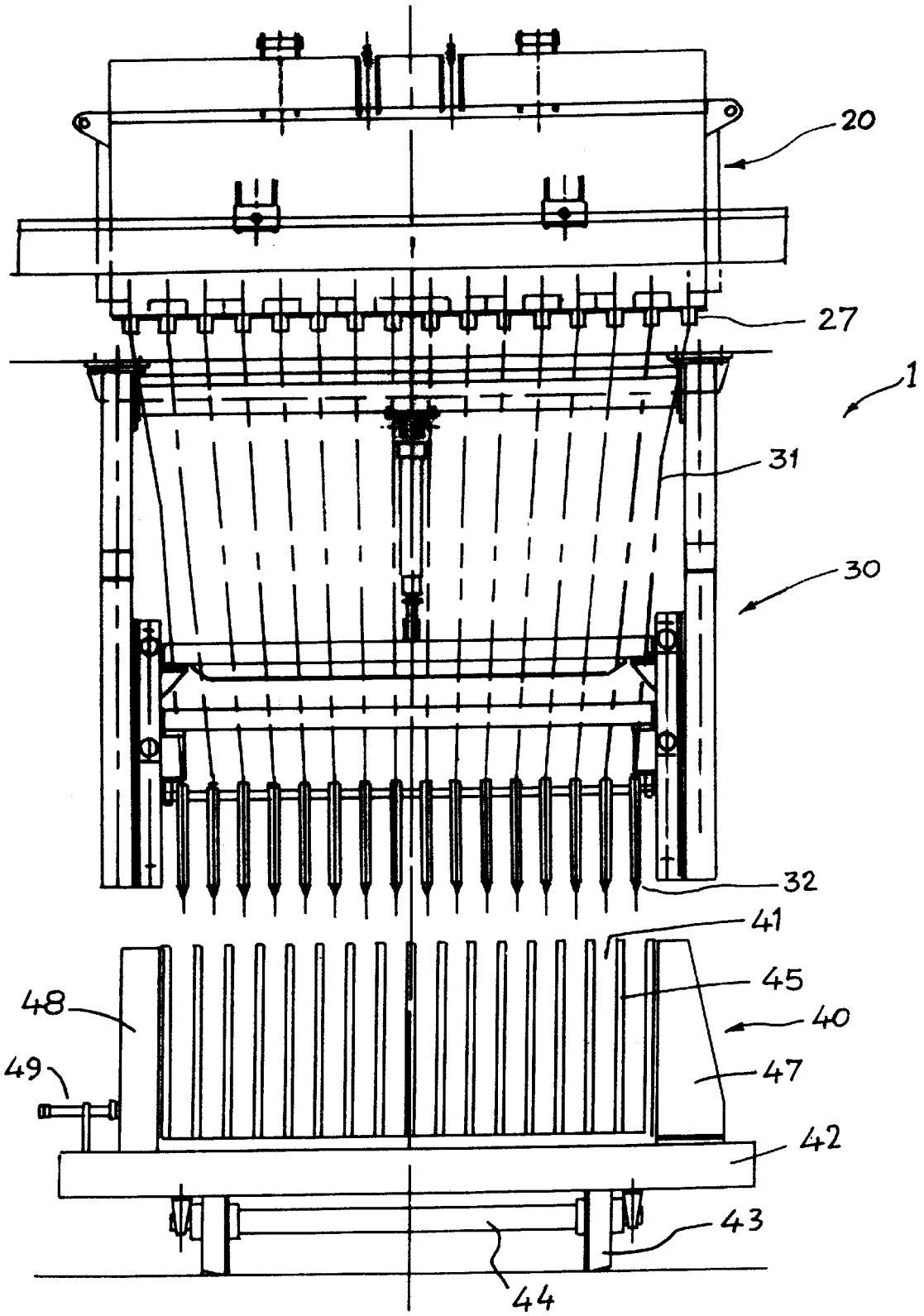
FIG. 1 shows the apparatus for simultaneous production of a plurality of panels.
Figure 3:
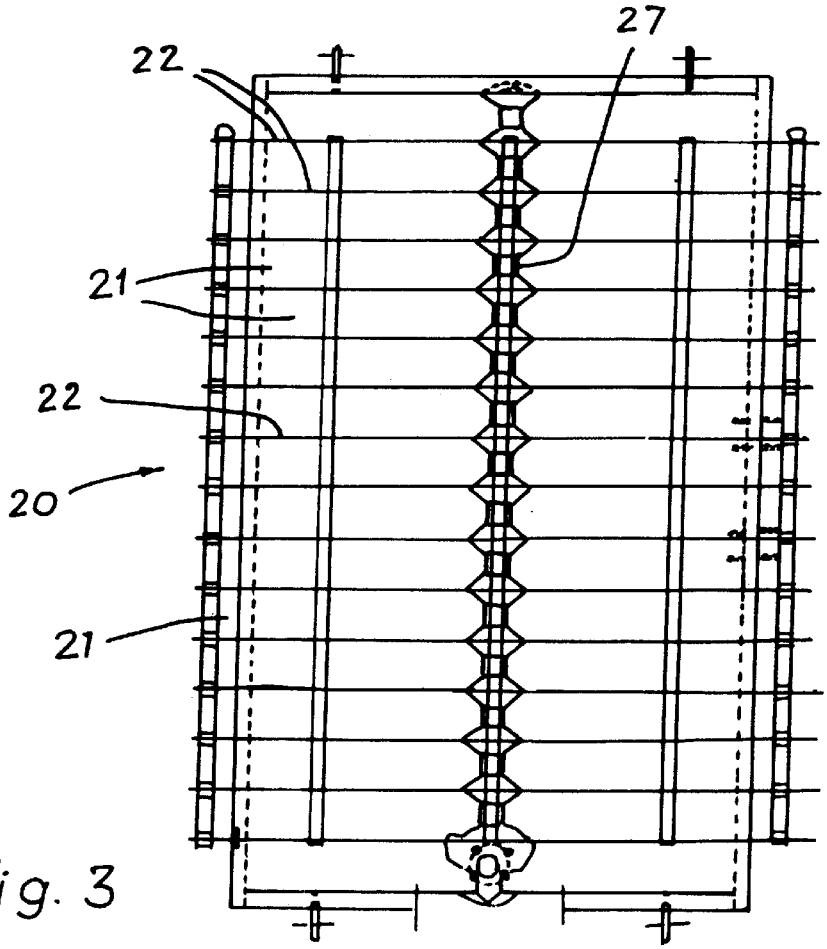
FIG. 3 shows a plan view of a distribution tank.

Referring to FIGS. 1 and 3, the apparatus 1 for simultaneous production of multiple panels comprises a distribution tank 20 to feed slurry into an assembly mounted on a movable trolley 40 through a flow discharge member 30. Thus slurry is poured into distribution tank 20 having a plurality of compartments 21, and such that the number of compartments 21 correspond to the number of panels to be formed so as to allow a simultaneous production of a plurality of panels. The slurry from compartments 21 flow into a flow discharge member 30 comprising discharge pipes or tubes 31 corresponding to the number of compartments 21. Thus, a tube 31, is provided for each compartment. The apparatus 1 further comprises a movable trolley 40 having chambers 41 corresponding to the number of compartments 21 and tubes 31. As would be apparent for FIG. 1, each chamber 41 has its respective tube 31 and compartment 21 so that a plurality of panels can be formed simultaneously.

Figure 2:
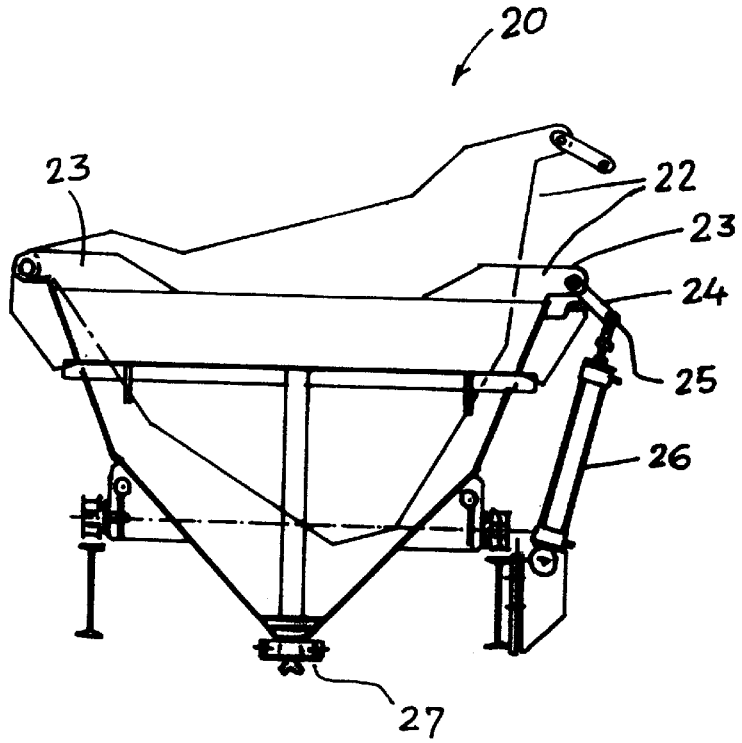
FIG. 2 shows a side view of a distribution tank.

Reference is now made to FIGS. 2 and 3 which illustrates the distribution tank 20 having a plurality of compartments 21. Compartments 21 are formed by separator plates 22 disposed in a spaced and parallel relationship and such as to define said compartments. Actuating means are provided for raising and lowering each of plates 22, said means comprising a bracket 23 at either end of tank 20, said bracket having a connecting link 24. One end of connecting link 24 is connected through a pin joint 25 to a hydraulic jack 26. Any known motive source (not shown) imparts a movement to hydraulic jack 26 for causing a movement to separator plates 22 and such as to allow a raising or lowering of said plates. In operation, plates 22 are raised and the slurry is fed into distribution tank 20. Upon completion of feeding of slurry in tank 20, plates 22 are lowered so as to form distinct compartments 21 to correspond to each panel.

FIGS. 2 and 3 show the means for raising and lowering of separator plates 22, such means are only illustrative in nature as any other raising and lowering means may be provided therefor.

Each of compartment 21 has a discharge valve 27 for facilitating a discharge of the slurry therefrom and into discharge flow means 30. Reference is made to FIG. 1 which illustrates the discharge means to comprise a plurality of flexible tubes 31, and such that each tube 31 is connected at the upper end to its respective discharge valve 27. A discharge slurry nozzle 32 is connected to the lower end of each of pipes 31, and a gravitational flow of the slurry is provided within each pipe 31.

Figure 4:
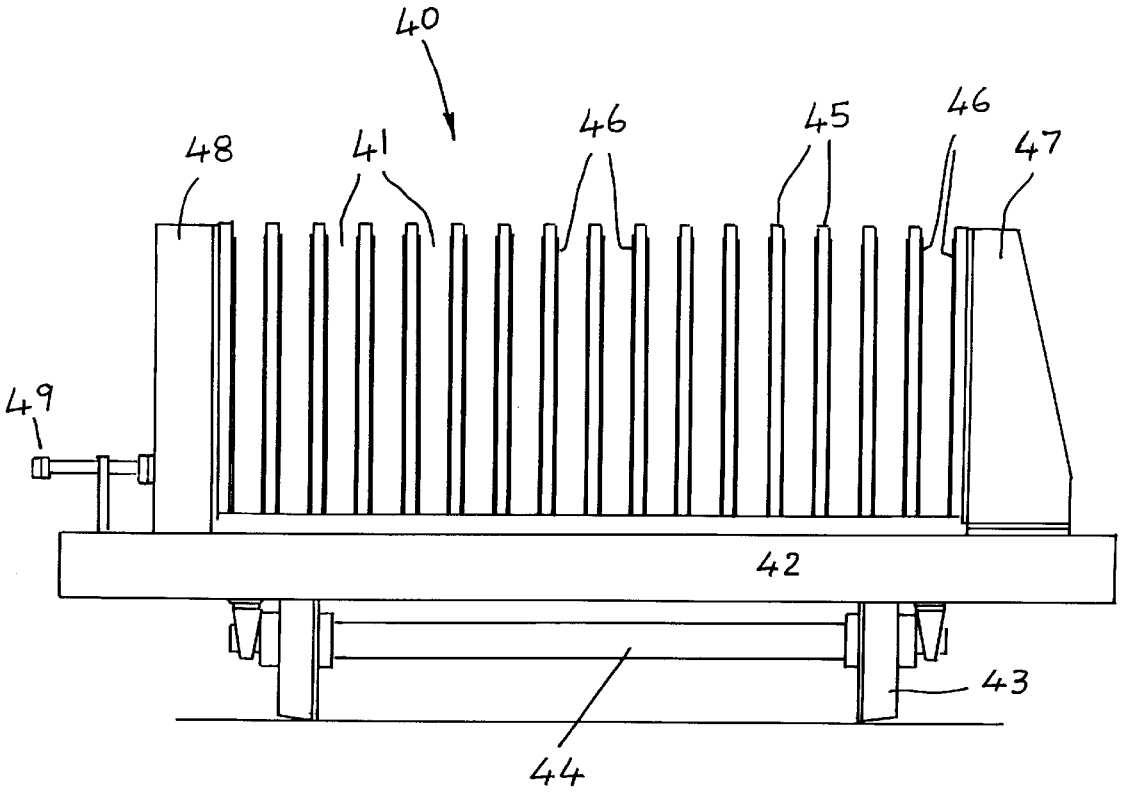
FIG. 4 shows a movable trolley with assembled chambers adapted to be moved below the distribution tank.

Nozzles 32 regulate the discharge of slurry into trolley assembly 40. Trolley assembly 40 comprises a trolley platform 42 mounted on rotable wheels 43 having an axle 44. A plurality of dividing frames 45 are mounted on platform 42 and in a spaced relationship to each other so as to define compartments 41 corresponding to those provided in distribution tank 20. FIG. 4 illustrates facing sheets 46 disposed along the inner wall surface of dividing frames 45. A fixed clamp 47 and a movable clamp 48 is mounted on platform 42, a clamping screw 49 being provided with movable clamp 48. The clamping mechanism allows the compartments 41 to be held in position when the slurry aerates and creates a side thrust. The trolley assembly is moved below the injecting nozzles 32. In such a position, the injecting nozzles 32 move downwardly into the respective compartments 41 and discharge a predetermined quantity of slurry. Upon completion of the operation of discharge of slurry from distribution tank 10, valves 27 close and injecting nozzles 32 move upwardly and away from the compartments 41. The trolley 40 is now allowed to move to the next station and a top extrusion placed over each compartment 41 and the slurry allowed to aerate to form a panel in each compartment, and upon completion of the setting period, the top, bottom and side extrusions are removed, the panels are separated and subjected to the known step of curing.

Several distinct advantages are derived by the apparatus of the present invention. One such advantage is that the process is continuous in nature. Yet another advantage is that a plurality of panels can be simultaneously produced.

What is claimed is:

1. Apparatus for producing construction panels, comprising:

a distribution tank for receiving a slurry for formation of the construction panels, the distribution tank having a plurality of separator plates disposed in a spaced apart relationship to each other so that a plurality of chambers are defined there between within the distribution tank and having an actuator means for raising and lowering respective ones of the plurality of separator plates;

a plurality of discharge valves provided respectively for each of the plurality of chambers of the distribution tank;

a plurality of flow discharge members disposed respectively below each of the plurality of discharge valves for receiving the slurry from the distribution tank; and a movable trolley having a plurality of chambers disposed respectively below each of the plurality of flow discharge members.

2. The apparatus as claimed in claim 1, wherein the plurality of chambers defined within the distribution tank each have a lower end, and wherein each respective discharge valve of the plurality of discharge valves is provided at the lower end of one of the plurality of chambers of the distribution tank.

3. The apparatus as claimed in claim 1, wherein the plurality of flow discharge members comprises a plurality of flexible pipes corresponding in number to that of the plurality of chambers of the distribution tank, each of the plurality of flexible pipes having a lower end and an upper end in which the upper end is adapted to be connected to a respective discharge valve of the plurality of discharge valves, and a plurality of slurry discharge nozzles connected to a perspective lower end of each pipe of the plurality of flexible pipes.

4. The apparatus as claimed in claim 3, wherein each of the plurality of slurry discharge nozzles is connected to an actuator means for causing a raising and a lowering of the respective one of the plurality of slurry discharge nozzles.

5. The apparatus as claimed in claim 1, wherein the plurality of chambers of the movable trolley are defined by a plurality of dividing frames and bottom extrusions, wherein the plurality of dividing frames have inner surfaces, and wherein facing sheets are mounted on the inner surfaces of the plurality of dividing frames.

6. The apparatus as claimed in claim 1, wherein the movable trolley has a fixed clamp and a moving clamp provided at respective ends thereof.

* * * * *